United States Patent [19]

Clark et al.

[11] 4,144,435

[45] Mar. 13, 1979

[54] VESSEL FOR USE IN A MICROWAVE OVEN

[75] Inventors: Clarence O. Clark; Robert L. DeAngelis; Kenneth F. Deffren; Thomas J. Flautt; Erwin A. Hofmann; Eugene Weinshenker, all of Cincinnati, Ohio

[73] Assignee: The Procter & Gamble Company, Cincinnati, Ohio

[21] Appl. No.: 853,581

[22] Filed: Nov. 21, 1977

[51] Int. Cl.[2] ..... H05B 9/06

[52] U.S. Cl. ..... 219/10.55 E; 99/DIG. 14; 426/241

[58] Field of Search ..... 219/10.55 E, 10.55 F, 219/10.55 M, 10.55 R; 99/DIG. 14; 426/241, 243

[56] References Cited

U.S. PATENT DOCUMENTS

| | | | |
|---|---|---|---|
| 3,219,460 | 11/1965 | Brown | 219/10.55 E X |
| 3,353,968 | 11/1967 | Krajewski | 219/10.55 E X |
| 3,615,713 | 10/1971 | Stevenson | 219/10.55 E X |
| 3,936,626 | 2/1976 | Moore | 219/10.55 E X |
| 3,985,990 | 10/1976 | Levinson | 219/10.55 E |
| 4,080,524 | 3/1978 | Greenfield, Jr. et al. | 219/10.55 E |

*Primary Examiner*—Arthur T. Grimley

*Attorney, Agent, or Firm*—Melville, Strasser, Foster & Hoffman

[57] ABSTRACT

A vessel, reflective to microwave electromagnetic energy, having at least one aperture to permit passage of said microwave energy to its contents and a shielding device, responsive to a preselected internal temperature of the vessel contents, to close said at least one aperture to prevent further passage of said microwave energy to the vessel contents.

25 Claims, 22 Drawing Figures

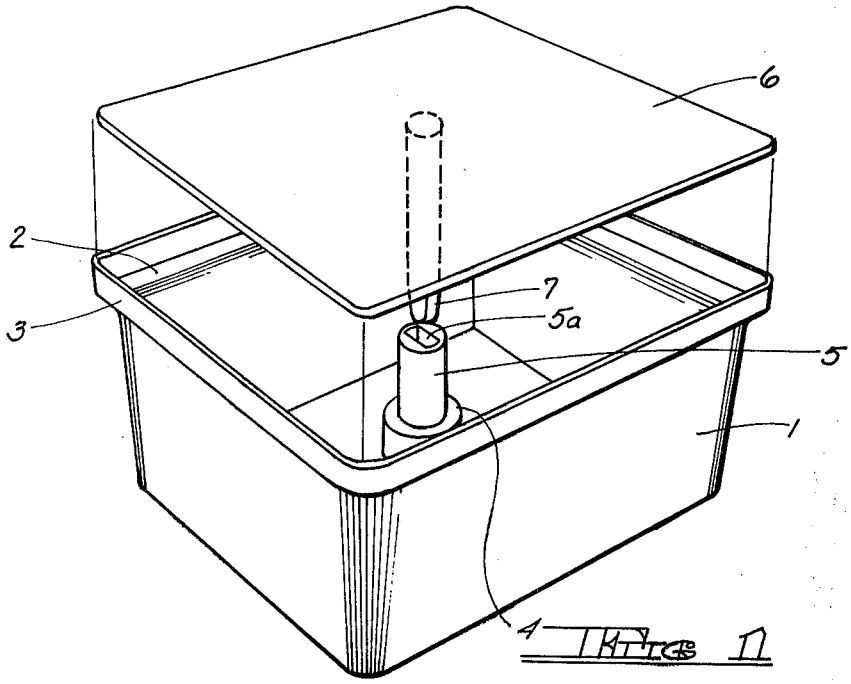
FIG. 1
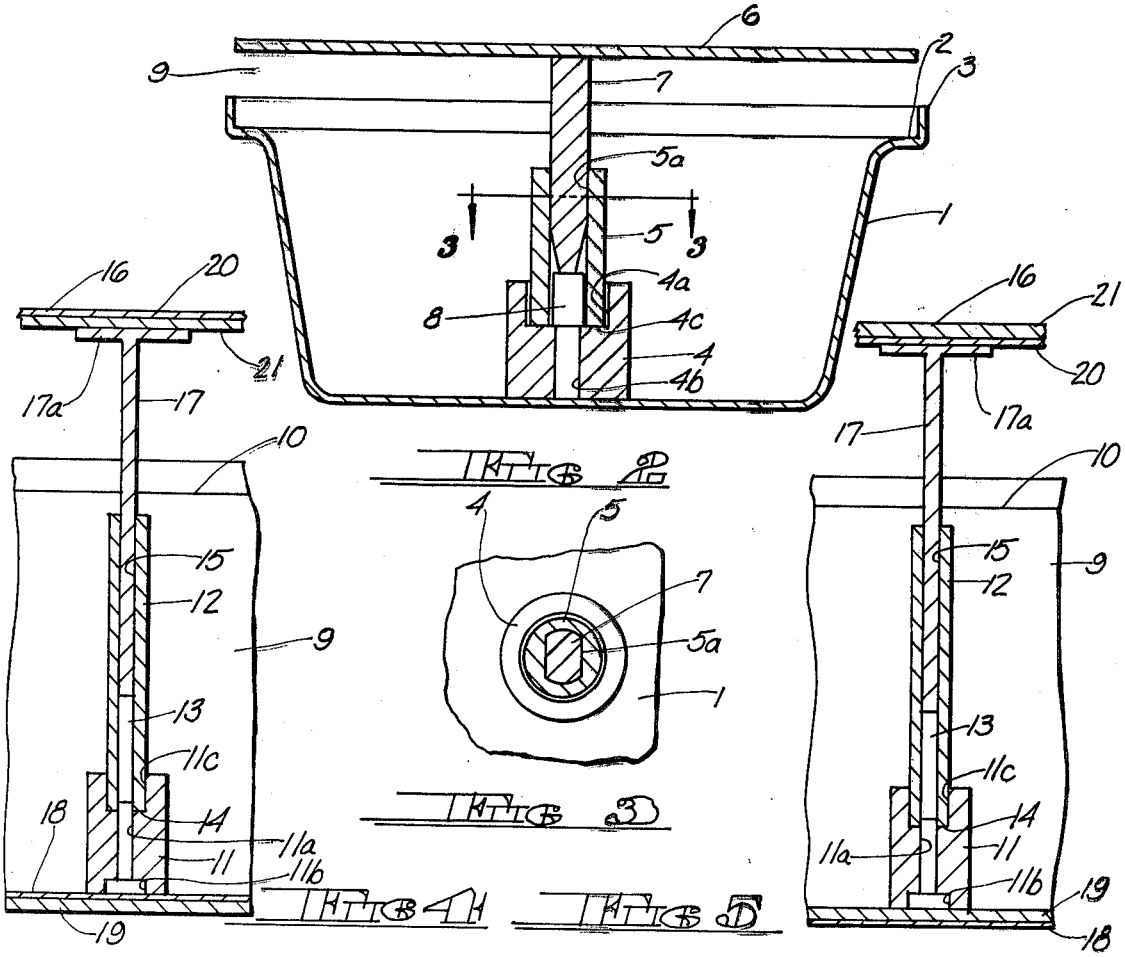
FIG. 2
FIG. 3
FIG. 4
FIG. 5

VESSEL FOR USE IN A MICROWAVE OVEN

BACKGROUND OF THE INVENTION

1. Field of the Invention

The invention relates to a vessel, and more particularly to a vessel which will initially permit the passage of microwave electromagnetic energy to heat the contents of the vessel until such time that the internal temperature of the vessel contents reaches a preselected level, at which time the vessel will shield the contents from the microwave energy.

2. Description of the Prior Art

The vessel of the present invention and the various embodiments thereof to be described have many uses. The material to be contained within the vessel does not constitute a limitation of the present invention and the vessel may be so constructed as to be used with electromagnetic energy of various wave lengths, as will be evident hereinafter.

For purposes of an exemplary showing, the vessel and its various embodiments will be described in their application as vessels for foods to be prepared in a microwave oven.

In recent years the use of microwave ovens to heat or cook foods has increased markedly both in the home and in commercial establishments. This is true for numerous reasons. For example, microwave ovens require no pre-warming, heat efficiently and result in energy savings. Many foods demonstrate a superior taste when prepared in a microwave oven and retain more of their nutritional components. They are perhaps best known for the speed with which they heat or cook and they offer both the homemaker and the commercial establishment rapid reheating of refrigerated pre-cooked foods.

Microwave ovens are not, however, without certain disadvantages. For example, heating or cooking by means of a microwave oven is so rapid that an error of several minutes can make the difference between a well done roast and a rare roast or properly cooked foods and over-cooked foods. Each food product, itself, possesses characteristics having a marked influence on cooking or heating time. For example, such factors as the quantity of the food product to be heated or cooked, the size of the food product, the shape of the food product, its consistency and its dielectric properties all influence the rapidity and uniformity with which it will be heated or cooked in a microwave oven. Furthermore, microwave ovens by different manufacturers differ in power outputs. Most domestic microwave ovens are produced with power outputs in the range of 600 watts to 1000 watts at a nominal frequency of 2,450 million cycles per second (2,450 MHZ). The nominal wavelength at this frequency is 12.2 cm (4.8 inches). Another nominal frequency assigned to microwave cooking is 915 MHz with a nominal wavelength of 33 cm (12.9 inches). Finally, the microwaves within the oven chamber tend in some places to reinforce each other and in other places to cancel each other with the result that a food product being heated or cooked in the microwave oven will often demonstrate hot and cold spots, adversely effecting the uniformity of heating or cooking.

All of the above noted factors result in the fact that heating or cooking with a microwave oven is generally more critical with respect to time than is conventional heating or cooking. It is not practical to attempt to simultaneously heat or cook several food products having different temperature requirements or energy absorbing characteristics. Furthermore, it is not practical to prepare one set of cooking instructions, based on time, which would be universally applicable to all microwave ovens.

Cooking experiments, especially with meats and the like, have shown that the internal temperature of the food product is the most reliable means to determine the degree of doneness. By the same token, external temperature of the food product does not correlate well with its degree of doneness. Some microwave ovens are equipped with a probe to detect the internal temperature of a food product being cooked therein and to turn off the oven when a predetermined internal temperature level is achieved. Nevertheless, in most cases only one food product can be cooked in the microwave oven at any given time.

The present invention is directed to a vessel for foods to be prepared in a microwave oven, the vessel being reflective to microwave energy and being provided with one or more apertures allowing passage of the microwave energy to the food product within the vessel. Shielding means are provided to close the one or more apertures so that the food product within the vessel is no longer subjected to substantial microwave energy. The shielding means is shifted from an aperture open position to an aperture closed position in response to a predetermined internal temperature of the food product within the vessel. Depending upon the precision with which the vessel and shielding means are made, the shielding means in its aperture closed position can reduce the microwave energy transmitted to the food product to virtually zero.

Since the vessel of the present invention is responsive to a predetermined internal temperature of the food product contained therein, the operator of a microwave oven is enabled to cook several food products with differing temperature requirements at the same time, when each food product is contained in a vessel of the present invention. With the use of such a vessel, food products can be heated or cooked in accordance with a single set of cooking instructions based on the internal temperature of the food product, regardless of the power output of the particular microwave oven being used. The vessel of the present invention may be made so as to be disposable or so as to be reusable.

SUMMARY OF THE INVENTION

In its broadest aspects, the invention relates to a vessel, reflective to microwave electromagnetic energy, having means to permit passage of such microwave energy to its contents and having additional means, responsive to a preselected internal temperature of the vessel contents, to substantially prevent further passage of such microwave energy to the vessel contents.

For purposes of an exemplary showing, the invention will be described as applied to vessels for food products to be prepared in a microwave oven. To this end, a vessel is provided, made of material reflective to microwave energy. The vessel has one or more apertures appropriately sized to permit the passage of microwave energy therethrough to the food product located therein. The vessel is additionally provided with a shielding means capable of being shifted from a position whereat the one or more vessel apertures are open, to a closed position whereat the one or more vessel apertures are closed or sufficiently reduced in effective size by the shielding means to substantially obviate further passage of microwave energy therethrough. Means are provided to shift the shielding means from its open position to its closed position in response to a preselected internal temperature of the food product within the vessel.

In one embodiment of the present invention the vessel is an open-top, microwave energy reflective, tray-like vessel having a vertically oriented cylindrical element mounted therein and so positioned as to be surrounded by the food product located therein. The shielding means comprises a substantially planar cover for the vessel having a centrally located, downwardly depending plunger. The plunger is adapted to be slidably received within the cylindrical element. During the cooking or heating process, the plunger is maintained at an elevated position by means of a fusible plug-like element disposed within the cylindrical element. This, in turn, results in the fact that the shielding means or cover of the vessel is maintained at an elevated position with respect to the vessel. When the surrounding food product achieves a sufficiently high temperature to melt the fusible plug (having been formulated to have a predetermined melting point), the plunger will slide downwardly into the cylindrical element causing the shielding means or cover of the vessel to close.

The above described embodiment may be modified by providing the vessel with a first cover having apertures therein, a second cover having a downwardly depending plunger extending through the first cover and being maintained at an elevated position with respect to the vessel by the fusible plug, the second cover shifting downwardly to cover the apertures in the first cover upon melting of the fusible plug.

In yet another embodiment, the vessel is provided with a first shielding cover having apertures therein. The cylindrical element containing the fusible plug comprises a probe affixed to the first cover. The probe is intended to extend into the food product located within the food vessel. A second shielding cover is provided with a plunger shiftable within the probe from an elevated position wherein the apertures in the first cover are exposed by the second cover to a closed position wherein the apertures of the first cover are shielded by the second cover.

In yet another embodiment, a first shielding cover for the vessel is provided with appropriately configured apertures. A second shielding cover is pivotally mounted to a shaft extending through the first cover and is provided with matching apertures. The shaft of the second cover extends into a probe containing a helical shaped bimetallic actuator. The probe is intended to be inserted in the food product located within the vessel so that the apertures in both covers coincide. When the food product reaches the predetermined temperature for activating the bimetallic actuator, the bimetallic actuator will cause the second cover to rotate with respect to the first until the apertures in both covers no longer coincide.

Additional embodiments of the vessel of the present invention involve the use of a first cover having apertures therein and a second cover having matching apertures. The second cover is rotatable or slidable with respect to the first between a position wherein the apertures of the covers coincide and a position wherein the apertures no longer coincide. Weight or spring means bias the second cover to its aperture closing position. The second cover is held in its position, wherein the apertures of both cover members correspond, by latch means. The latch means, in turn, are released either by a probe-like trigger mechanism or a fusible plug in a probe located within the food product in the vessel and activated or melted when the internal temperature of the food product reaches a predetermined level.

All of the embodiments of the present invention may be manufactured in a disposable form, a reusable form or a partially disposable-partially reusable form, as will be described hereinafter. In all of the embodiments of the vessel, the number and/or size of the apertures will determine the amount of microwave energy transmitted to the food product during the heating or cooking step.

BRIEF DESCRIPTION OF THE DRAWINGS

FIG. 1 is an exploded perspective view of one embodiment of the vessel of the present invention.

FIG. 2 is a cross-sectional, elevational view of the embodiment of FIG. 1.

FIG. 3 is a fragmentary cross sectional view taken along sections line 3—3 of FIG. 2.

FIGS. 4 and 5 are fragmentary, cross sectional elevational views, similar to FIG. 2, and illustrating the vessel and cover as being of laminated construction.

FIG. 22 is a cross sectional, elevational view illustrating the application of insulation to a vessel of the present invention.

DESCRIPTION OF THE PREFERRED EMBODIMENT

Figure 6:
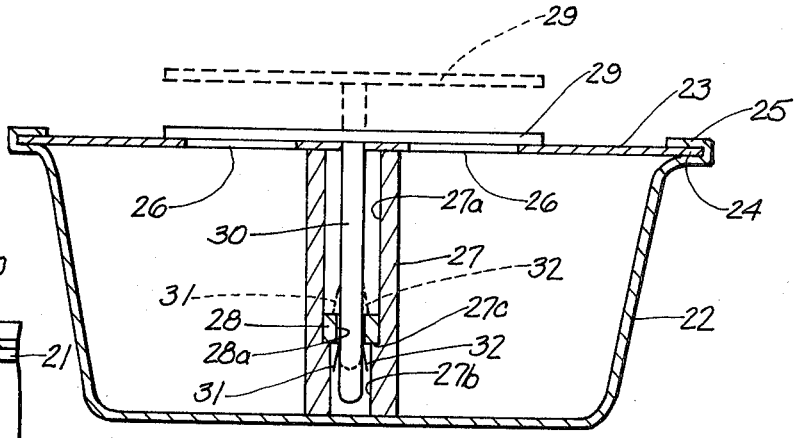
FIG. 6 is an elevational view, partly in cross section, of another embodiment of the present invention.

A first embodiment of the present invention is illustrated in FIGS. 1 through 3, wherein like parts have been given like index numerals. The vessel 1 may be made of any appropriate microwave energy reflective material. For purposes of an exemplary showing it is illustrated as being a disposable, formed, aluminum foil tray-like vessel of the type in which food products are conventionally packaged. The vessel has the usual cover supporting shoulder 2 and an upstanding flange 3 which is normally crimped over the peripheral edges of a cover or lid for the vessel prior to the opening thereof by the consumer.

Located centrally of the vessel 1 there is a first support member 4, which may have any appropriate cross sectional configuration and is shown to be substantially cylindrical in the figures. The first support member 4 has a first axial bore 4*a* and a second axial bore 4*b*, the diameter of axial bore 4*a* being larger than that of axial bore 4*b* so as to define a shoulder 4*c*. A second substantially cylindrical support member is shown at 5, and is so dimensioned as to be received in the axial bore 4*a* of the first support member 4, resting upon shoulder 4*c*. The second support member has an axial bore 5*a*. The second support member 5 may be held in the first support member by a frictional engagement, adhesive means, or the like. The support members 4 and 5 may be made of any suitable non-metallic, non-self heating material which is capable of withstanding the temperature of the food product (not shown) which surrounds the support members and which is appropriate to be in contact with the food product. The term "non-self heating" as used herein and in the claims refers to the fact that the material will not be heated by the microwave energy itself. They may, for example, be fabricated of fiberglass or the like. Alternatively, the support members 4 and 5 may constitute a single, integral, one-piece structure molded of appropriate plastic material. When molded as a one-piece structure, the bore 5*a* again must be of slightly larger dimensions than the bore 4*b* so that the shoulder 4*c* is present at the bottom end of bore 5*a*.

The support members 4 and 5, whether separate elements joined together or a single, integral, one-piece element, may be affixed to the bottom of vessel 1 by any appropriate means (not shown). These means may include an adhesive, a crimping engagement between the vessel bottom and the first support members 4*b*, or the like.

A cover or lid 6 is provided for the vessel 1. The cover 6 may be made of any suitable microwave energy reflective material. To this end, for example, the cover 6 may be made of metallic foil such as aluminum foil or of a foil covered paper, or foil covered plastic.

The cover 6 has affixed to it, centrally of its underside, a downwardly depending plunger 7. The plunger 7 may be made of any appropriate non-metallic, non-self heating material such as fiberglass, plastic or the like, as described with respect to the support members 4 and 5. The plunger 7 is affixed to the underside of cover 6 by any suitable means (not shown) such as by adhesive means, by a crimping engagement or the like.

Plunger 7 is adapted to be slidingly received within the bore 5*a* of the second support member 5. Preferably, the bore 5*a* and the plunger 7 are of non-circular cross section, as shown in FIG. 3, so that the plunger is non-rotatable within bore 5*a*. This assures appropriate alignment of cover 6 with respect to vessel 1.

FIG. 2 illustrates the vessel in its cooking or heating mode. Again it will be understood that the vessel will contain a food product (not shown) surrounding the first and second support members 4 and 5. An appropriately configured fusible plug 8 is placed within bore 5*a* and is supported above bore 4*b* by shoulder 4*c*. The fusible plug 8 is so formulated as to have a melting point closely approximating that internal temperature of the food product which will assure the desired doneness of the food product. If the food product is to be served immediately, the melting point of the fusible plug may closely approximate the desired serving temperature. If the food product is not to be served immediately, the melting point of the fusible plug should be less than the desired serving temperature to accommodate for the well known carry-over cooking phenomenon which occurs during standing time by virtue of conduction and equilibration.

The cover plunger 7 is located in bore 5*a* with its lowermost end resting upon the fusible plug 8. The fusible plug maintains the cover 6 at an elevated position with respect to the vessel 1 so that during the heating or cooking operation the microwave energy may be transmitted to the food product within vessel 1 through the peripheral slot 9 defined by the distance between the vessel 1 and cover 6.

When the internal temperature of the food product reaches the preselected level, the fusible plug 8 will melt (having been chosen to have a melting point closely approximating the preselected temperature level). The melted plug 8 will be received within the bore 4*b* of the first support member 4 with the result that the plunger 7 will be free to slide downwardly in bore 5*a* of the second support member 5 under the influence of gravity. This will result in downward movement of cover 6 until it rests upon vessel shoulder 2, whereby the cover 6 and vessel 1 effectively shield the food product from the microwave energy.

The fusible plug 8 may be made of any appropriate material. For instance, waxes formulated to have a predetermined melting point are readily available on the market. For example, such waxes are available from the Kindt-Collins Company of Cleveland, Ohio, under the mark Kinco. A series of available Kinco waxes may be listed by grade designation and melting point temperature as follows: 378 Y (127° F.), 278 - L (143° F.), 278 M (153° F.), 278 A (180° F.), and 478 - X (190°–195° F.). It has been found that with the use of a wax plug such as that shown at 8 in FIG. 2, the plug 8 will melt and the cover 6 will close within a range of from 0° to 5° of the desired, preselected internal temperature for the food product, upon appropriate selection of the wax. As used herein and in the claims, the term "fusible plug" is intended to encompass any non-toxic material (wax or otherwise) capable of being formulated or selected to melt at a given predetermined temperature and capable of being formed into an appropriately shaped plug.

The disposable vessel of FIGS. 1 through 3 may be sold to the consumer as a package for the food product therein with the various parts in their relative positions illustrated in FIG. 2, the vessel 1 and cover 6 having an appropriate over-wrap. Under these circumstances, the consumer need only remove the overwrap and place the vessel and its contents into the chamber of the microwave oven. Alternatively, the plug 8 may be packaged outside of bore 5*a*. This would permit plunger 7 and cover 6 to be in their lowermost positions, with the vessel flange 3 crimped over the peripheral edges of cover 6. The consumer, in this instance, need only lift the vessel flange 3, remove the cover 6 and its plunger 7, insert plug 8 in bore 5*a* and replace the cover with plunger 7 located within the bore 5*a* and resting upon plug 8. At this point, the vessel would be ready to be located in the chamber of a microwave oven.

In FIG. 4 a vessel 9 is shown which may be similar to vessel 1 of FIGS. 1 and 2, including a shoulder 10 equivalent to shoulder 2 of FIGS. 1 and 2. In the embodiment of FIG. 4 the first support member 11 and the second support member 12 are similar to support members 4 and 5 of FIGS. 1 and 2. The support members 11 and 12 of FIG. 4 differ from their counterparts in FIGS. 1 and 2 in that they are of considerably lesser diameter, taking up less room within the container 9. The first support 11 has a bore 11*a* extending axially therethrough and enlarged near the bottom as at 11*b* and near the top as at 11*c*. The bores 11*a* and 11*b* constitute a reservoir for fusible plug 13. The bores 11*a* and 11*c* define a shoulder 14 therebetween which supports the second support member 12. The second support member 12 has an axial bore 15 which is preferably non-circular, as described with respect to bore 5*a* of FIG. 3.

The vessel has a top 16 provided with a downwardly depending plunger 17 adapted to be slidably received within the bore 15 of second support member 12 and to rest upon the fusible plug 13. The plunger 17 may have an enlarged upper end, as at 17*a*, affixed to the underside of cover 16.

For purposes of an exemplary showing, the vessel 9 is illustrated as being made up of a laminate of foil and paperboard or the like. The foil layer is illustrated at 18 and the paperboard layer is shown at 19. The cover 16 similarly comprises a laminate made up of an exterior foil layer 20 and a layer 21 of paperboard or the like. Such a laminated construction has several advantages. The foil layers 18 and 20 are made of any appropriate microwave reflective metal such as aluminum or the like and less metal is required than in the embodiment in FIGS. 1 and 2. The foil layers 18 and 20 again act as microwave energy shields and the laminate arrangement will tend to minimize arcing between the vessel 9 and cover 16. With respect to the vessel, the inner foil layer 18 will directly reflect radiant heat back to the food product (not shown) within the vessel while the exterior layer 19 of paperboard or the like will act as an insulator against conduction of heat from the microwave over to the interior of the vessel. While the plug 13 may constitute a preformed member of wax or other appropriate fusible material, it is not required that it be preformed. The second support member 12 may simply be inserted in a quantity of fusible material to a depth sufficient to provide the required plug. The second support member may thereafter be located within bore 11*c* of the first support member 11. The smaller the amount of material in the fusible plug, the more precise will be the cut-off or closing of the vessel.

FIG. 5 illustrates an embodiment which is substantially the same as FIG. 4 and like parts have been given like index numerals. FIG. 5 differs from FIG. 4 only in that the positions of the foil and paperboard lamina of the vessel 9 and cover 16 have been reversed. With the container 9 having an exterior foil layer 18, the foil will act not only as a microwave barrier but as a radiant heat barrier, while the inner layer 19 of paperboard or the like prevents conduction of heat between the food product (not shown) within the vessel and the foil layer. Where it is desired to steam the food product, the inner layer 18 may be made of waxed paper, plastic, plastic impregnated paper or the like, impervious to water and/or fat. It will be understood by one skilled in the art that the operation of the embodiments of FIGS. 4 and 5 is essentially the same as that described with respect to the embodiment of FIGS. 1 through 3. Furthermore, the cover 16 of FIG. 4 could be used with the vessel 9 of FIG. 5 and the cover 16 of FIG. 5 could be used with the vessel 9 of FIG. 4.

While the embodiments of FIGS. 1 through 5 have been described as being disposable, single-use vessels, it will be understood that these embodiments are not so limited. For example, vessel 1 and cover 6 may be made of heavier gauge aluminum or other appropriate microwave energy shielding material, rather than of foil. Under these circumstances, it would be desirable that the first support member 4 (whether a separate element or integral with the second support member 5) be detachably mounted to the bottom of the vessel 1 so that the fusible material of plug 8 could be removed from the bore 4*b* after each use of the vessel.

It would also be within the scope of the invention to make the vessel 1 and support members 4 and 5 disposable in nature, while the cover 6 and plunger 7 would be made to be reusable. Under these circumstances, the cover 6 could be made of a relatively thin gauge plate of aluminum or other appropriate microwave energy reflective material. Such reusable covers 6 could be made in sizes to fit standard foil (or foil laminate) tray-like vessels of the type illustrated in FIGS. 1, 2, 4 and 5.

FIG. 6 illustrates an embodiment of the invention similar to those of FIGS. 1 through 5. Once again, the vessel 22 may constitute a disposable foil vessel of the type described with respect to FIGS. 1 and 2 or a disposable foil laminate vessel as shown in FIGS. 4 and 5. The vessel is provided with a first cover 23 which rests upon the peripheral shoulder 24 of the vessel and is maintained in place by a peripheral flange 25 of the vessel crimped over the edges of the first cover 23. The first cover 23 has a series of apertures 26 so sized as to permit the passage of the microwave energy to the food product (not shown) within the vessel 22.

For purposes of an exemplary showing, the vessel 22 is illustrated as being provided with a central, upstanding support member 27 constituting an integral, one-piece structure fabricated or molded of any appropriate non-metallic, non-self heating material suitable to be in contact with a food product and capable of withstanding the internal temperatures of the food product. It may, for example, be molded of plastic or the like. It will be understood that the support member 27 could be a two piece structure similar to support members 4 and 5 of FIG. 2 or support members 11 and 12 of FIGS. 4 and 5. The support member 27 may be affixed to the bottom surface of vessel 22 in any of the ways described with respect to support member 4 of FIG. 2.

Support member 27 has a first bore 27*a* and a second bore 27*b*. The bore 27*a* is of slightly larger diameter than the bore 27*b* providing a shoulder 27*c* therebetween. The shoulder 27*c* is intended to support a fusible plug 28 having a central bore 28*a*, preferably of non-circular configuration. The plug 28 is so sized as to have a frictional fit within bore 27*a*.

A second cover 29 is provided, having a downwardly depending plunger 30. The covers 23 and 29 should be microwave energy reflective and may be made of any appropriate material as described with respect to cover 6 of FIGS. 1 and 2 or the covers 16 of FIGS. 4 and 5.

The plunger 30 is preferably of the same non-circular cross sectional configuration as the bore 28*a* of fusible plug 28, so that the plunger is freely slidable within the plug bore 28*a* and the cover 29 will be maintained in its proper orientation. If the cover 29 and the apertures 26 are configured in the manner to be described with respect to FIGS. 8 and 9 below, the plunger 30 and the plug bore 27*a* may be of circular configuration, since the orientation of second cover 29 is of no consequence.

Again, the plunger 30 may be affixed to the underside of second cover 29 in any suitable manner.

The structure of FIG. 6, when filled with a food product, may be sold to the consumer with the parts in their relative positions as shown in full lines in FIG. 6 (i.e., with second cover 29 in its downward or closed position). The plunger 30 is provided with at least one lateral resilient tine. Two such tines are shown at 30 and 32. The tines normally rest in the positions shown. The tines may constitute integral parts of the plunger 30 or may be resilient elements affixed to the plunger 30. When the vessel is to be used in a microwave oven, it is only necessary to raise the second cover 29 to the position shown in broken lines. The tines 31 and 32 will shift against the body of plunger 30 enabling them to be drawn through the bore 28*a* of the fusible plug 28. Once through the bore 28*a*, the tines 31 and 32 are free to return to their normal position and will rest on the upper surface of the fusible plug 28, maintaining the second cover 29 in its upper or open position as shown in broken lines in FIG. 6. This will enable the microwave energy to be transmitted through apertures 26 to the food product within vessel 22.

When the internal temperature of the food product within vessel 22 achieves the desired pre-selected level, the fusible plug 28 (so chosen as to have a melting point closely approximating that temperature level) will melt, the fusible material entering bore 27*b*. As a consequence, the plunger 30 and the second cover 29 will be free to shift downwardly under the influence of gravity, closing apertures 26 and shielding the food product from the microwave energy.

The embodiment of FIG. 6 is susceptible of the same modifications described with respect to the embodiment of FIGS. 1 through 3 and may be made wholly disposable, partially disposable or reusable. It would also be within the scope of the invention to eliminate the first cover 23, making second cover 29 equivalent to cover 6 of FIGS. 1 and 2.

Figure 7:
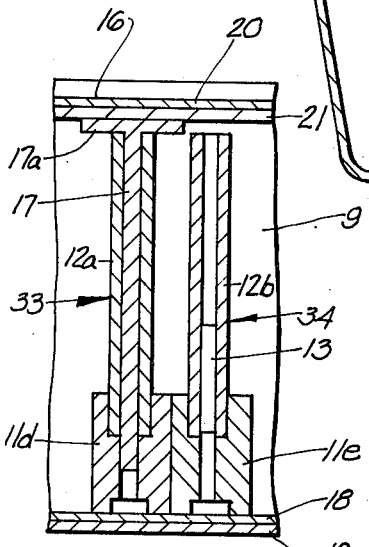
FIG. 7 is a fragmentary, cross sectional elevational view, similar to FIG. 4 and illustrating the use of two support assemblies.

FIG. 7 illustrates another way in which the vessel of FIGS. 1 through 5 may be packaged and presented to the consumer with the cover of the vessel in its lowermost position resting on shoulder 2 and maintained in place by flange 3 crimped thereover, as described above with respect to FIG. 2. For purposes of an exemplary showing an embodiment similar to that of FIG. 4 has been used and like parts have been given like index numerals. The structure of FIG. 7 differs from that of FIG. 4 in that the vessel 9 is provided with two support means, generally indicated at 33 and 34. The support means 33 and 34 may be identical and may also be identical to the support means of FIG. 4. To this end, support means 33 comprises a first support member 11*d* and a second support member 12*a*, while support means 34 comprises a first support member 11*e* and a second support member 12*b*. Support means 33 and 34 are mounted on the bottom of vessel 9 so as to be equidistant from the center of the vessel bottom. For purposes of an exemplary showing they are illustrated as being located side by side. It will be understood that the first support means 11*d* and 11*e* could constitute a single molded element.

The cover 16 of the vessel is provided with a plunger 17. The plunger 17 is mounted to the underside of cover 16 at a distance from the center thereof corresponding to the offset from the center of the bottom of vessel 9 at which the support means 33 and 34 are located.

When the vessel is provided with a food product or the like (not shown) the cover 16 is placed upon the vessel with the plunger 17 located within second support member 12*a* of support means 33. When the package is to be used by the consumer, it is only necessary for the consumer to remove cover 16, rotate it 180° and replace it so that plunger 17 enters the bore of second support member 12*b* of support means 34. Since support means 34 carries a fusible plug 13, the plunger 17 will contact the fusible plug, maintaining the cover 16 in an elevated position similar to that shown in FIG. 4. The vessel is now ready for use in a microwave oven. When the food product therewithin reaches the desired predetermined internal temperature, the fusible plug 13 will melt, permitting the cover 16 to shift downwardly to its closed position.

Figure 8:
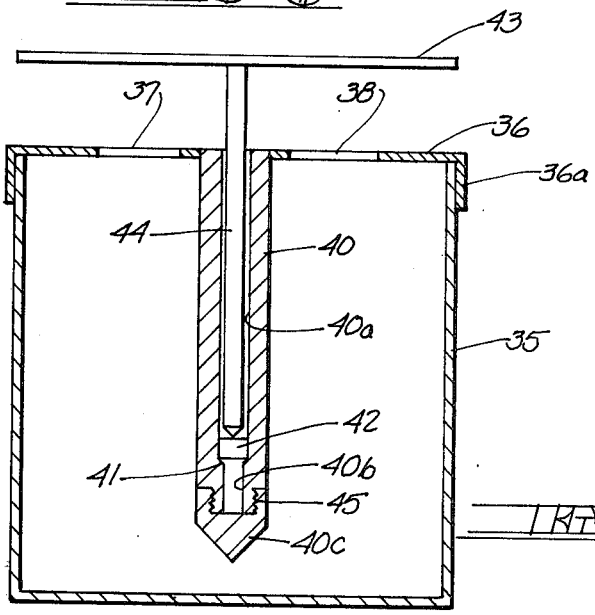
FIG. 8 is an elevational view, partly in cross section, of yet another embodiment of the vessel of the present invention.
Figure 9:
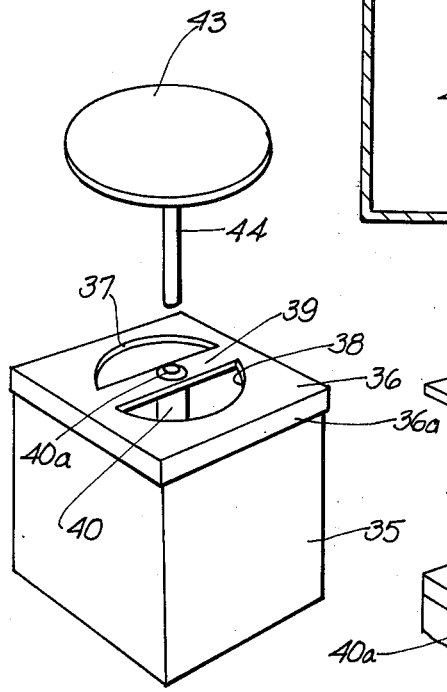
FIG. 9 is an exploded perspective view of the embodiment of FIG. 5.

Another embodiment of the present invention is illustrated in FIGS. 8 and 9. For purposes of an exemplary illustration, the embodiment of FIGS. 8 and 9 is shown in reusable form. In this embodiment the vessel 35 may be made of aluminum or any other appropriate microwave energy reflective material. The vessel is provided with a first cover 36, which may be removably affixable to the vessel 35 in any appropriate way. For purposes of an exemplary showing, the cover 36 is illustrated as having a downwardly depending peripheral flange 36*a* which engages the sides of the vessel 35. The cover 18 is microwave energy reflective and may also be made of aluminum or the like.

The first cover 36 is provided with a pair of apertures 37 and 38, the outer peripheries of which constitute a part of the same circle. The central portion 39 of first cover 36 supports a downwardly depending probe 40 adapted to be inserted into the food product (not shown) within vessel 35. The probe 40 may be made of any appropriate non-self heating material including fiberglass, plastic, or the like and may be attached to the central portion 39 of first cover 36 in any appropriate way. The probe 40 has a central bore 40*a* terminating in a coaxial bore 40*b* of lesser diameter, forming a shoulder 41 therebetween. The shoulder 41 is adapted to support a fusible plug 42 of the type described with respect to FIG. 2.

A second cover 43 is provided, having a downwardly depending plunger 44 adapted to be slidingly received in the probe bore 40*a*. The second cover 43 is made of a microwave energy reflective material (such as aluminum) and the probe 44 may be affixed thereto in any appropriate manner. While the peripheral configuration of the second cover 43 does not constitute a limitation on the present invention, it is preferably circular and of a diameter larger than the diameter of the outer periphery of apertures 37 and 38. As a result of this, the second cover 43 need not have any preferred orientation with respect to first cover 36 and its apertures 37 and 38.

The plunger 44 is made of non-self heating material and is adapted to rest upon the fusible plug 42. When the internal temperature of the food product surrounding probe 40 reaches the desired predetermined level, the appropriately selected fusible plug 42 will melt permitting the second cover 43 and plunger 44 to shift downwardly until the second cover shields apertures 37 and 38. The melted plug will pass into the lower portion of bore 40*b*. The lowermost end 40*c* of probe 40 may constitute a separate removable portion of the probe, threadedly engaged to the remainder of the probe as at 45. This will permit removal of the melted plug from bore 40*b* after each use of the vessel.

Figure 10:
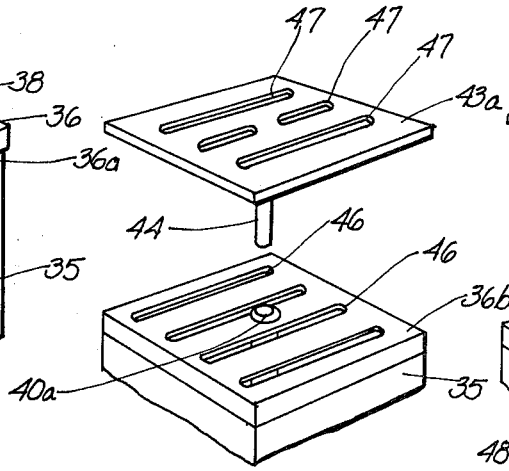
FIGS. 10 and 11 are fragmentary, exploded, perspective views similar to FIG. 8 and illustrating alternative aperture arrangements.
Figure 11:
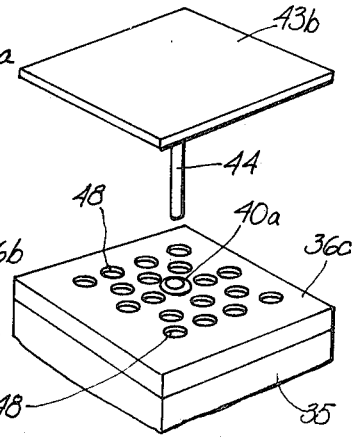

The embodiment of FIGS. 8 and 9 is not limited to the particular configuration of apertures 37 and 38 illustrated. Other aperture arrangements may be provided. Other exemplary arrangements are illustrated in FIGS. 10 and 11. Turning first to FIG. 10, the vessel 35 is provided with a first cover **36*b* which differs from cover 36 of FIGS. 8 and 9 only in that it is provided with a series of apertures 46 in the form of elongated, parallel slots. The second cover 43*a* differs from second cover 43 of FIGS. 8 and 9 in that it is of rectangular configuration and is also provided with a series of elongated, parallel slots 47. The slots 47 are shifted laterally with respect to the slots 46. Thus, when the second cover 43*a* shifts to its downward or shielding position, the slots 46 and 47 will both be effectively closed, the slots 47 overlying those portions of first cover 36*b* between slots 46**.

Another arrangement is illustrated in FIG. 11 wherein the vessel 35 is provided with a first cover **36*c*. The first cover 36*c* differs from first cover 36 of FIGS. 8 and 9 in that it is provided with a plurality of circular apertures 48. A second cover 43*b* is provided. The cover 43*b* differs from cover 43 only in that it is of rectangular or square configuration, rather than circular. When cover 43*b* shifts to its lowermost position, it will effectively shield apertures 48. It has been found that when apertures 48 are formed with a diameter of about ¾ inch and are located on about one inch centers, excellent uniformity of the microwave energy entering vessel 35** is achieved when a nominal frequency of 2450 MHz is used.

In all of the embodiments of FIGS. 1 through 11, it has been found that excellent results are achieved when the covers 6, 16, 29, 43, **43*a* and 43*b* are raised from their respective vessels by a distance of from ¼ to 1 inch, when using microwave energy having a wavelength of 4.8 inches (12.2 cm). The distance between the vessel and the shiftable shielding cover will determine, in part at least, the amount of microwave energy transmitted to the food product within the vessel. The same is true of the size and configuration of apertures in FIGS. 8 through 11**. The areas of the apertures will also determine, in part at least, the amount of microwave energy transmitted therethrough.

The present invention is not limited to the use of a fusible plug as a triggering means for the shielding cover member. A bimetallic element may also be used. As used herein and in the claims, the term "bimetallic" element or actuator is intended to encompass the well known bipolymer elements or actuators which function in much the same way.

Figure 12:
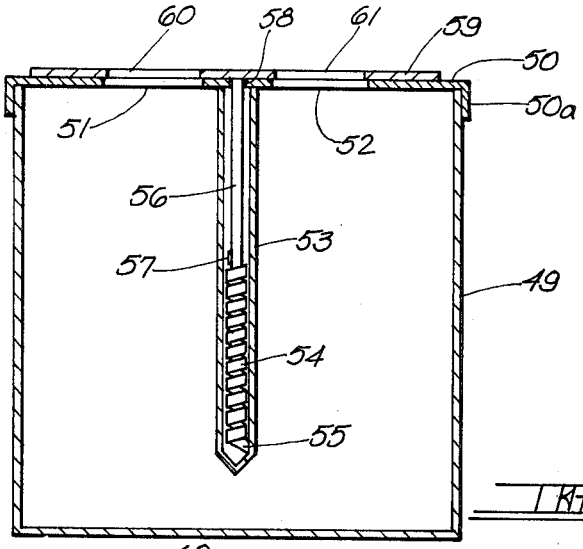
FIG. 12 is a cross sectional, elevational view of yet another embodiment of the present invention.
Figure 13:
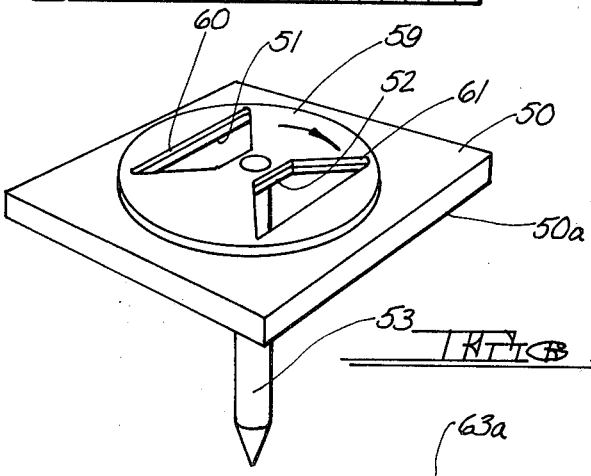
FIG. 13 is a perspective view of the cover elements and probe of the embodiment of FIG. 12.

Reference is made to FIGS. 12 and 13. A vessel 49 of microwave energy reflective material is provided, similar to the vessel 35 of FIGS. 8 and 9. The vessel 49 is provided with a first cover 50, again similar to the cover 36 of FIGS. 8 and 9 and shown as having a peripheral flange **50*a*. The cover 50 has a pair of apertures 51 and 52 formed therein, so sized as to permit the passage of microwave energy to the food product (not shown) within the vessel 49. Centrally of first cover 50 there is located a downwardly depending probe 53, which may be affixed to the underside of cover 50 in any appropriate manner and which is intended to be inserted into a food product within vessel 49. The probe 53 is hollow, non-self heating and contains a bimetallic actuator 54 of helical configuration. One end of the bimetallic actuator 54 is affixed to the inside surface of the probe 53, as at 55. The other end of the bimetallic actuator 54 is affixed to a shaft 56, as at 57. The shaft extends upwardly through a perforation 58 in first cover member 50. The upper end of shaft 56 is attached centrally to the underside of a second cover 59. Second cover 59 is also microwave energy reflective and has a pair of apertures 60 and 61, corresponding to apertures 51 and 52 of first cover 50 and being of substantially the same size. The shaft 56 is rotatable in the perforation 58 of first cover 50 so that the second cover 59 is rotatable with respect to the first cover 50**.

Normally, the vessel and its attendant parts are in their relative positions as illustrated in FIGS. 12 and 13. The bimetallic actuator 54 will be so selected that when the food product (not shown) within vessel 49 nears its predetermined internal temperature indicating doneness, the bimetallic actuator 54 will cause rotation of second cover 59 until, at the preselected temperature, the apertures 51 and 52 of first cover 50 and the apertures 60 and 61 of second cover 59 no longer correspond. As a result, the second cover 59 effectively closes the apertures 51 and 52 of first cover 50, shielding the food product from the microwave energy.

The vessel of the present invention may also be triggered by a fusible temperature responsive trigger device of the type taught in U.S. Pat. No. 3,682,130. Briefly, the device comprises a hollow probe-like shell having a plunger shiftable therein from a retracted position wholly within the shell to an extended position part way out of the shell. The plunger is biased to its extended position by a coil spring and is held in its retracted position by a quantity of solidified fusible material. The plunger may be made to shift from its retracted to its extended position at any preselected temperature, by appropriately selecting the solidified fusible material. Such temperature responsive trigger devices are sold by Minnesota Mining and Manufacturing Company of Minneapolis, Minn. under the trademark DUN-RITE.

Figure 14:
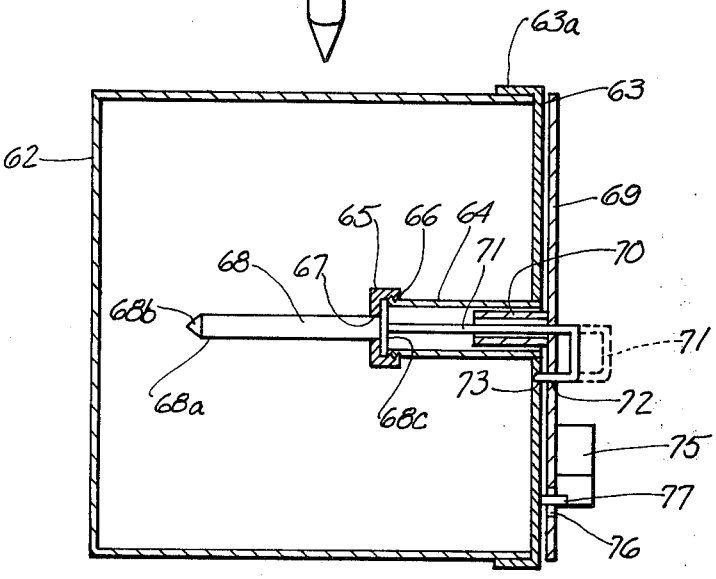
FIG. 14 is a cross sectional elevational view of another embodiment of the present invention.
Figure 15:
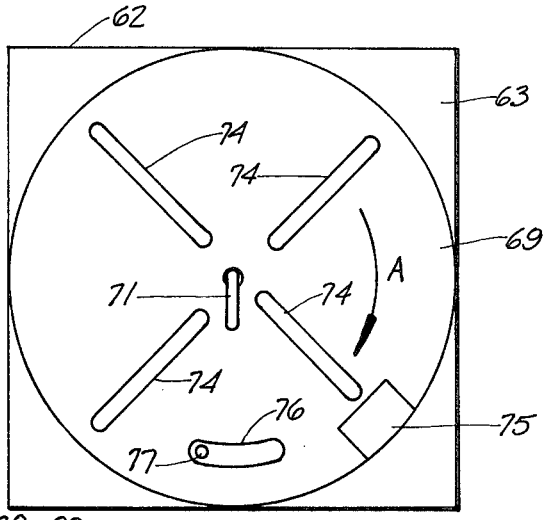
FIG. 15 is an elevational view of the embodiment of FIG. 14 as seen from the right of that Figure.

Reference is now made to FIGS. 14 and 15. In these figures a microwave energy reflective vessel is shown at 62. The vessel 62 is equivalent to vessel 35 of FIG. 8 or vessel 49 of FIG. 12 and is illustrated lying on its side. The vessel 62 is provided with a first microwave energy reflective cover 63 which may be affixed to vessel 62 in any appropriate manner. For purposes of an exemplary showing, the first cover 63 is illustrated as having a peripheral flange similar to the peripheral flange **36*a* of cover 36 of FIG. 8 or the peripheral flange 50*a* of cover 50 of FIG. 12. The cover 63 has an inwardly extending, hollow, cylindrical support 64 affixed thereto in any suitable manner. The free end of support 64 is provided with a cap 65 threadedly engaged therewith as at 66. The cap has a central perforation 67 through which a temperature responsive trigger device 68 of the type taught in the above mentioned U.S. Pat. No. 3,682,130 extends. The trigger device 68 has a probe-like body 68*a* terminating at one end in a point 68*b* and having a peripheral flange 68*c* at the other end. The peripheral flange 68*c* is adapted to fit just nicely within cap 65 and to be trapped between cap 65 and the end of support 64 when cap 65 is threadedly engaged on support 64. A second microwave reflective cover 69 is provided for the vessel. The second cover 69 has an inwardly extending, hollow, cylindrical support 70 affixed thereto in any appropriate manner. The support 70 is so sized as to be just nicely received within the support 64 of first cover 63** and to be rotatable therein.

The hollow support 70 is adapted to slidingly receive the long leg of a J-shaped latch member 71. When the latch member 71 is in its latching position, as shown in FIG. 14, the long leg thereof rests against the retracted plunger (not shown) of trigger 68. The short leg of the J-shaped latch member extends through a perforation 72 in second cover 69 and into a depression 73 in first cover 63.

FIG. 15 illustrates the vessel with second cover 69 in its latched position. The first cover 63 and second cover 69 are provided with a plurality of slots corresponding in number, size, shape and position. When second cover 69 is in its latched position, the slots thereof overlie the slots of cover 63. The corresponding and overlying slots are indicated at 74 in FIG. 15.

Near its periphery, the second cover 69 is provided with a counterweight 75. It will be evident that when the second cover 69 is released by latch 71 the counterweight 75 will tend to cause the second cover to rotate in the direction of arrow A. The second cover 69 is provided with an elongated, arcuate slot 76. The first cover 63 has an upstanding pin 77 mounted thereon and extending into the slot 76 of second cover 69. The coaction of slot 76 and pin 77 will determine the closed position of second cover 69, in which position the slots of second cover 69 no longer overlie the slots of the first cover 63 and the second cover 69 shields the food product within vessel 62 from the microwave energy.

Use of the vessel 62 may be described as follows. The food product to be heated or cooked is placed in the vessel and a trigger element 68 is appropriately mounted on support 64 by means of cap 65. The first cover 63 is then mounted on the vessel 62. The second cover 69 is rotated with respect to the first cover until the slots of both correspond and the short leg of latch member 71 is located in depression 73 in first cover 63. The entire assembly may then be oriented as shown in FIGS. 14 and 15 and located within the chamber of a microwave oven. The slots are so sized as to permit the passage of microwave energy therethrough to the food product within the vessel 62. When the internal temperature of the food product reaches the predetermined level, indicating doneness, the appropriately selected trigger element 68 will be activated and its plunger will shift latch member 71 to its position shown in broken lines in FIG. 14, wherein the short leg of the latch member will no longer be located in the depression 73 of first cover 63. As a consequence, the second cover 69 will be free to rotate in the direction of arrow A under the influence of counterweight 75 until stopped by the interaction of slot 76 and pin 77. In its unlatched position, the second cover 69 will effectively shield the slots in first cover 63 preventing further microwave energy from reaching the food product within vessel 62.

Figure 16:
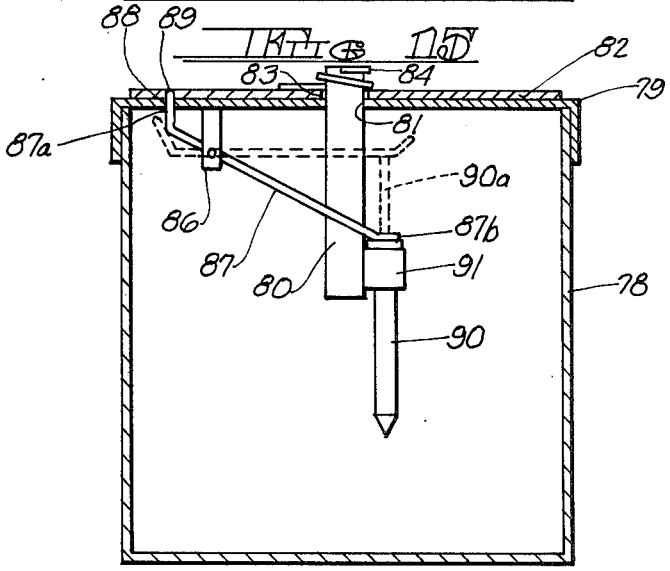
FIG. 16 is an elevational, cross sectional view of yet another embodiment of the present invention.
Figure 17:
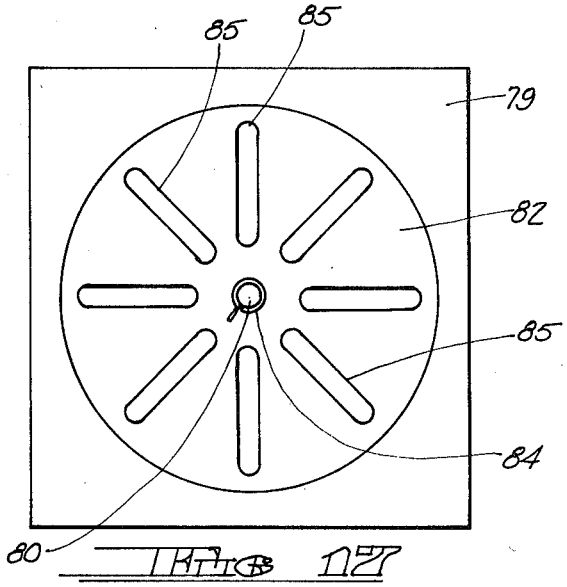
FIG. 17 is a plan view of the structure of FIG. 16.

FIGS. 16 and 17 illustrate a modification of the structure of FIGS. 14 and 15. In this embodiment a microwave energy reflective vessel is shown at 78, the upper end of which is opened and is provided with a first cover 79. A vertical shaft 80 is non-rotatively mounted in a perforation 81 in the first cover 79 with the majority of its length extending downwardly from cover 79 and a lesser portion extending upwardly therefrom. A second cover 82 is provided with a central perforation 83 so sized as to receive the upper portion of shaft 80 and to be rotatable thereabout. The upper end of shaft 80 is surrounded by a spring 84. One end of the spring is affixed to the upper end of the shaft 80, the other end of the spring being affixed to the second cover 82.

The first cover 79 and the second cover 82 are provided with slots corresponding in size, shape, placement and number. The spring 84 is so arranged that when it is in its neutral position, the slots of the second cover 82 are out of alignment with the slots of the first cover 79 so that the second cover 82 shields the slots of the first cover 79. In FIG. 17, the slots of first and second covers 79 and 82 are shown in alignment and are indicated at 85.

In order to maintain alignment of the slots as shown at 85 in FIG. 17, it is necessary to latch the second cover 82 against the action of spring 84. To this end, first cover 79 is provided with a downwardly depending support 86 to which is pivoted a latch 87. One end 87*a* of latch 87 is adapted, when the latch is in latching position, to extend through a perforation 88 in first cover 79 into a depression 89 in second cover 82 holding the second cover in the position shown in FIG. 17.

The other end 87*b* of latch 87 is adapted to rest atop the retracted plunger (not shown) of a temperature responsive trigger 90 identical to the temperature responsive trigger 68 of FIG. 14. Trigger 90 may be removably mounted by clip means 91 attached to the lower end of shaft 80.

The operation of the embodiment of FIGS. 16 and 17 may be described as follows. The food product (not shown) to be heated or cooked in vessel 78 is located therein. The second cover 82 is rotated against the action of spring 84 so that its slots are in alignment with the slots of first cover 79 and the second cover 82 is locked in place by latch 87 oriented in the position shown in full lines in FIG. 16. A trigger 90 is mounted in clip 91 and the lid assembly is applied to the vessel 78 with the trigger assembly imbedded in the food product. When the food product attains the predetermined internal temperature indicating doneness, the trigger 90, having been appropriately selected, will be activated and its plunger (shown at 90*a* in broken lines in FIG. 16) will cause the latch 87 to assume the position shown in broken lines in FIG. 16. This will release the second cover 82 permitting spring 84 to cause the second cover to rotate until its slots are out of alignment with the slots in first cover 79, effectively shielding the slots in first cover 79 and preventing further microwave energy from being transmitted to the food product within vessel 78.

Figure 18:
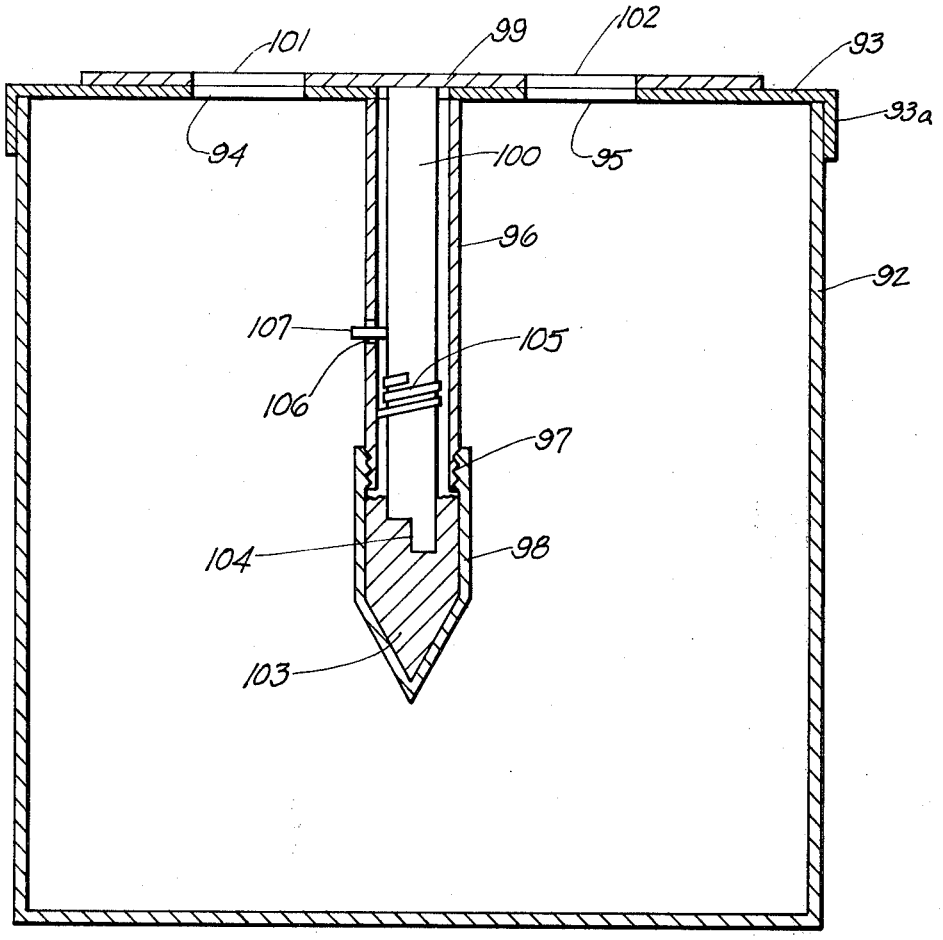
FIG. 18 is an elevational view, partly in cross section, of an embodiment similar to FIG. 12 utilizing a fusible plug triggering means.

Another embodiment of the present invention is illustrated in FIG. 18. This embodiment comprises a vessel 92 which may be equivalent to any of the vessels illustrated in FIGS. 12, 14 and 16. The vessel 92 is made of microwave energy reflective material such as aluminum, or the like. The vessel is provided with a first cover 93 which also is made of microwave energy reflective material, such as aluminum. The cover 93 is removably affixable to vessel 92 by any appropriate means such as the peripheral flange 93*a* which engages the sides of the vessel 92. The first cover 93 has one or more microwave energy transmitting apertures therein. Two such apertures are shown at 94 and 95. Affixed to the underside of first cover 93 there is a downwardly depending, hollow support 96. Threadedly engaged to the free end of support 96, as at 97, there is a pointed probe element 98. The probe element 98 is made of a non-self heating material. The hollow support 96 may also be made of non-self heating material.

A second cover 99, again of microwave energy reflective material, is provided, having a downwardly depending central shaft 100 affixed thereto. The shaft 100 is so sized as to be rotatively received within hollow support 96. The second cover 99 has apertures corresponding in number, size, shape and placement to the apertures of first cover 93. Two such apertures are shown at 101 and 102.

The lowermost end of shaft 100 extends into the probe element 98. The probe element 98 may be filled with a fusible material 103 so selected as to have a melting point approximating the internal temperature of the food product (not shown) within vessel 92, representing the desired doneness of the food product. It will be noted that the lowermost end of shaft 100 is imbedded in the fusible material 103. To assure adequate engagement between the lowermost end of shaft 100 and the fusible material 103, the lowermost end of shaft 100 may be provided with at least one flat, as shown at 104.

The parts are so arranged that the solid fusible material 103 will normally hold the shaft 100 and second cover 99 in such a rotative position that the apertures 101 and 102 of the second cover will overlie the apertures 94 and 95 of the first cover 93 permitting passage of microwave enery to the food product within the vessel. Means are provided to bias the second cover 99 to a position wherein its apertures are no longer in overlying relationship with the apertures of first cover 93 so that the second cover effectively shields the food product within vessel 92 from microwave energy. This biasing of the second cover 99 to its closed position may be accomplished in several ways. First of all, the second cover may be provided with a counterweight equivalent to the counterweight 75 of the embodiment of FIGS. 14 and 15. Under these circumstances the vessel 92 will be placed on its side during the cooking operation. Alternatively, a spring biasing means may be used. For purposes of an exemplary showing, a spring 105 is illustrated, one end of which is attached to the shaft 100 and the other end of which is attached to the support 96. The spring 105 will operate in much the same way described with respect to spring 84 of FIGS. 16 and 17.

In use, a food product (not shown) is placed within the vessel 92. The cover assembly is then mounted upon the vessel 92 with the probe element 98 imbedded in the food product. When the desired internal temperature of the food product is achieved, the appropriately selected fusible material 103 will melt, releasing its hold on the shaft 100. The biasing means will then cause the second cover 99 to shift to its closed position.

The open and closed positions of the second cover 99 may be determined in several ways. First of all, a slot and pin arrangement of the type shown at 76–77 in FIG. 15 may be used. Alternatively, a slot 106 may be formed in the wall of support 96 to accommodate a laterally extending pin 107 mounted on shaft 100. The slot 106 will be so dimensioned that when the pin 107 is located at one end of the slot 106, the second cover 99 will be in its open position, and when the pin 107 is located at the other end of slot 106, the second cover will be in its closed position.

When the vessel 92 is to be used again, the fusible material 103 may be replaced by a different fusible material having a different melting point, as desired. If the same fusible material is to be used again, it would be possible, immediately after use, to return the second cover 99 to its open position and hold it there until the fusible material 103 resolidifies, the embodiment of FIG. 18 thus being resettable.

Figure 19:
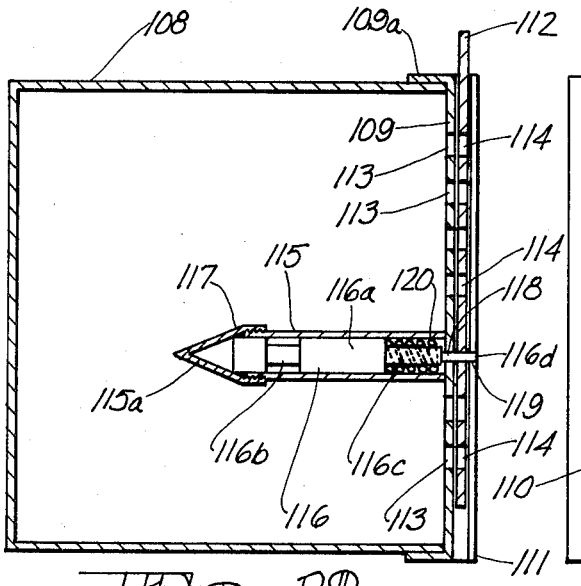
FIGS. 19, 20 and 21 are respectively a cross sectional, elevational view, a front elevational view and a fragmentary plan view of another embodiment of the present invention.
Figure 20:
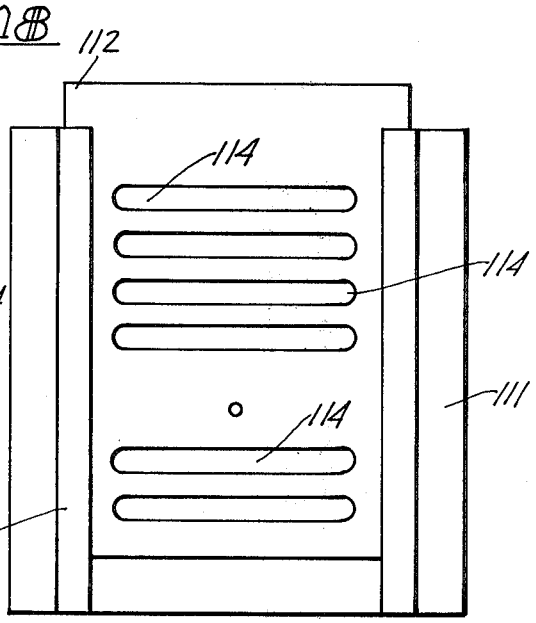
Figure 21:
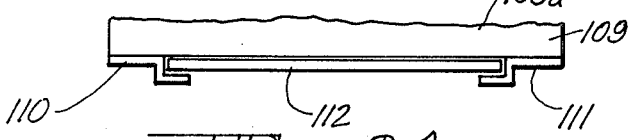
Figure 20:
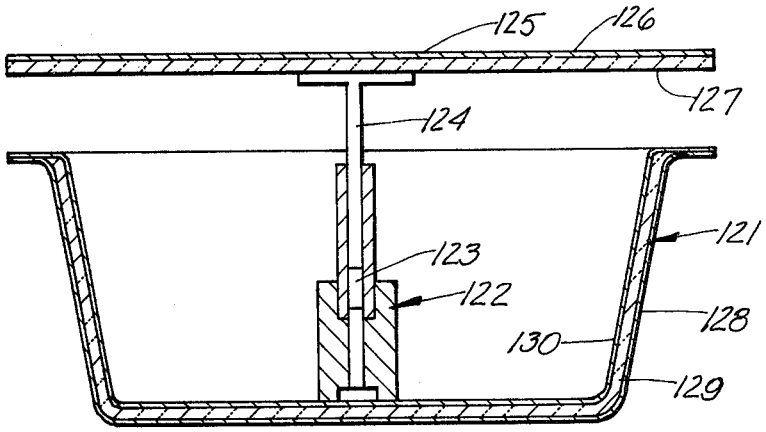

Yet another embodiment of the present invention is illustrated in FIGS. 19 through 21. In this embodiment a vessel 108 is provided, similar to the vessels shown heretofore, as for example in FIG. 14. The vessel 108 is made of microwave reflective material and is provided with a first cover 109 similarly made of microwave reflective material. The first cover 109 may be provided with a peripheral flange **109*a* engaging the vessel 108. Affixed to the firt cover 109 are a pair of substantially Z-shaped guides 110 and 111 (see FIG. 21). Slidably mounted within the guides 110 and 111 is a second cover 112. The first cover 109 has a plurality of parallel, elongated slots 113. The second cover 112 also has a pluraity of parallel slots 114 of the same size and spacing as the slots 113**.

Means are provided to hold the second cover 112 in an elevated position so that its slots 114 correspond to and overlie the slots 113 of the first cover 109 so that microwave energy may enter vessel 108. In FIGS. 19 and 20, the second cover 112 is illustrated in its elevated position. When the holding means is triggered, releasing the second cover 112, it will shift downwardly in guides 110 and 111 to a position wherein the slots 114 of second cover 112 no longer correspond with the slots 113 of first cover 109, effectively shielding the contents of vessel 108 from microwave energy.

The triggering means of this embodiment is most clearly shown in FIG. 19. The triggering means comprises a hollow probe 115 affixed to the inside surface of the first cover 109 and extending inwardly therefrom. The hollow probe may have a removable end **115*a*. Slidably mounted within the hollow probe is a piston 116 having a main body portion 116*a* of a diameter substantially the same as the internal diameter of probe 115. At one end, the piston 116 has a second body portion 116*b* of lesser diameter which is intended to abut against a plug 117 of fusible material of the type described above. The other end of piston 116 has a portion 116*c* of lesser diameter, terminating in a nose portion 116*d* adapted to extend through a perforation 118 in the first cover 109 and a coaxial perforation 119 in the second cover 112. The nose portion 116*d* of piston 116 when extending through perforations 118 and 119 will maintain the second cover 112 in its elevated position wherein microwave energy may enter the vessel 108 through slots 113 and 114**.

A compression spring 120 is mounted on portion **116*c* of piston 116. One end of the spring abuts the first cover 109, while the other end of the spring abuts a shoulder on piston 116 formed between piston portions 116*a* and 116*c*. It will be evident that compression spring 120 will urge the piston toward the pointed end of probe 115. When a food product (not shown) is located within the vessel and has attained a desired predetermined internal temperature, the fusible plug 17 will melt enabling spring 120 to shift piston 116 to the left (as viewed in FIG. 19) releasing the first cover 112 to fall to its closed position. The hollow probe 115, its end 115*a* and the piston 116** are fabricated of non-self heating material.

It will be understood by one skilled in the art that the vessels and cover assemblies of FIGS. 8 through 21 may be made disposable or partially disposable in the same manner described with respect to the embodiment of FIGS. 1 through 3. The size and shape of the vessels of the present invention do not constitute a limitation. Any of the embodiments of FIGS. 8 through 21 may be provided with any of the aperture arrangments illustrated in these various figures. The shape of the apertures may vary widely, as may their number. It will be understood that the greater the total area of aperture, the more microwave energy will pass therethrough and the more rapid will be the heating rate.

As in the case of the fusible plugs described above, the triggering elements 68 of FIGS. 14 and 19 of FIG. 16 are available with various reaction temperatures. It would be within the scope of the invention to make the bimetallic element or actuator 54 of FIG. 12 adjustable so as to react over a range of predetermined temperatures. As indicated above, in selecting a predetermined temperature at which the vessels of the present invention are to shield their contents from microwave energy, standing time and resulting carry-over cooking must be taken into account if the food product is not served immediately.

Carry-over cooking during standing time is the result of both conduction and equilibration. Taking the vessel of FIGS. 1 and 2 as an example, during standing time the foil vessel 1 will conduct heat from the microwave oven walls and the like to the food product in the vessel. Similarly, equilibration of temperature will take place within the food product itself. The effects of carry-over cooking can be reduced by providing an insulative layer in association with the vessel. All of the vessels of the present invention may be provided with such an insulative layer. For purposes of an exemplary showing, FIG. 22 illustrates a vessel similar to that shown in FIGS. 1 and 2. The vessel is generally indicated at 121 and is provided with a central support, generally indicated at 122. The support 122 contains a fusible plug 123 and is adapted to accommodate a plunger 124 affixed to the underside of a vessel cover 125. The vessel cover 125 may have any appropriate construction as described above. For purpose of an exemplary showing it is illustrated as comprising a metal foil layer 126 and an insulative layer 127.

The vessel 121 comprises an outer pan 128, an insulative layer 129 and an inner liner 130. The outer pan 128 is preferably made of microwave energy reflective material such as aluminum or aluminum foil. The insulative layer 129 may comprise any appropriate insulative material such as urethane foam, standard foam rubber, styrofoam, teflon, polypropylene or silicon rubber. The thickness of the insulative layer does not constitute a limitation on the present invention. It has been determined, for example, that a $\frac{1}{8}$ inch thick layer of urethane foam is adequate for most applications. The inner liner 130, again, may be made of any appropriate material such as metal, metal foil, plastic, glass, ceramic or the like.

When the vessel 121 of FIG. 22 is used in a microwave oven, and upon attainment of the desired preselected internal temperature of the vessel contents (not shown), the fusible plug 123 will melt causing the cover 125 to shift downwardly to its closed position. This will substantially completely shield the vessel contents from the microwave energy. The presence of insulative layer 129 will effectively prevent conduction so that carry-over cooking during a standing or holding period will occur by equilibration only. This will, to some extent, reduce the effects of the carry-over cooking phenomenon, giving the operator a measure of leeway with respect to holding time of the product prior to serving.

Modifications may be made in the invention without departing from the spirit of it.

The embodiments of the invention in which an exclusive property or priviledge is claimed are defined as follows:

1. A vessel for use in a microwave electromagnetic field for enclosing a product to be heated by microwave energy, said vessel being reflective to said microwave energy, means in association with said vessel to permit the passage of said microwave energy therein to said product and means responsive to a preselected internal temperature of said product to substantially reduce further passage of said microwave energy to said product.

2. The structure claimed in claim 1, wherein said vessel has an open top, a cover for said vessel, said cover being reflective to said microwave energy, said cover being vertically shiftable by gravity from a first position spaced upwardly from said open top of said vessel to a second position wherein said cover substantially closes said open top of said vessel, said temperature responsive means being positioned to maintain said cover in said first position and to release said cover to said second position upon attainment of said preselected temperature.

3. The structure claimed in claim 2 including a vertical, non-self heating support mounted in said vessel and adapted to be surrounded by said product, said support having an axial bore, a downwardly depending non-self heating plunger affixed to said cover, said plunger having a sliding fit within said support bore, said temperature responsive means comprising a fusible plug having a melting point closely approximating said preselected temperature, said fusible plug being located in said bore of said support, said plunger being supportable by said fusible plug to maintain said cover in said first position, whereby when said product reaches said desired internal temperature causing said fusible plug to melt, said fusible plug will no longer support said plunger and said cover will gravitate to said second position.

4. The structure claimed in claim 3 wherein said plunger and said support bore are of the same non-circular cross section whereby to maintain proper orientation of said cover with respect to said vessel.

5. The structure claimed in claim 3 wherein said fusible plug comprises a wax body.

6. The structure claimed in claim 3 wherein said fusible plug has an axial bore through which said plunger may extend with a sliding fit, said plunger having at least one laterally extending resilient tine near its lowermost end whereby said vessel may be presented to a consumer with said cover in said second position and said plunger extending through said fusible plug bore, said consumer when desiring to use said vessel raising said cover to said first position drawing said plunger end and its at least one tine through said fusible plug bore whereupon said fusible plug will be engaged on its upper surface by said at least one resilient tine and will support said plunger to maintan said cover in said first position.

7. The structure claimed in claim 3 including a second non-self heating support with an axial bore mounted in said vessel, said plunger having a sliding fit in said bore of said second support, said first mentioned support and said second support being mounted in said vessel equidistant from the vertical axis of said vessel, said plunger being affixed to said cover and spaced from the vertical axis of said cover by the same distance said support means are spaced from said vertical axis of said vessel, whereby said vessel may be presented to a consumer with said cover in said second position and said plunger fully seated in said bore of said second support means, said consumer when desiring to use said container removing said cover therefrom, rotating said cover 180° about its vertical axis and inserting said plunger into said bore of said first mentioned support and into contact with said fusible plug.

8. The structure claimed in claim 3 wherein said vessel and said cover each comprise an aluminum foil-paperboard laminate.

9. The structure claimed in claim 1, wherein said vessel has an open top, a first cover for said open top made of material reflective to said microwave energy and having at least one aperture permitting passage of said microwave energy to the interior of said vessel, a second cover reflective to said microwave energy, said second cover being vertically shiftable by gravity from a first position spaced upwardly from said first cover to a second position wherein said second cover substantially covers said at least one aperture in said first cover, said temperature responsive means being positioned to maintain said second cover in said first position and to release said second cover to said second position upon attainment of said preselected temperature.

10. The structure claimed in claim 9 including a downwardly depending, non-self heating probe affixed to the underside of said first cover and such length as to extend into and be surrounded by said product, said probe having an axial bore open at the upper end of said probe and closed at the bottom end of said probe, a downwardly depending, non-self heating plunger affixed to the underside of said second cover, said plunger having a sliding fit within said probe bore, said temperature responsive means comprising a fusible plug having a melting point closely approximating said preselected temperature, said fusible plug being located in said bore of said probe, said plunger being supportable by said fusible plug to maintain said second cover in said first position, whereby when said product reaches said desired internal temperature causing said fusible plug to melt, said fusible plug will no longer support said plunger and said second cover will gravitate to said second position.

11. The structure claimed in claim 10 wherein said first and second covers are provided with a plurality of microwave energy passing apertures in the form of elongated parallel slots, said slots of said second cover being laterally offset with respect to said slots of said first cover.

12. The structure claimed in claim 10 wherein said first cover is provided with a plurality of microwave energy passing apertures in the form of circular apertures of a diameter of about ¾ inch on about 1 inch centers.

13. The structure claimed in claim 9 including a vertical, non-self heating support mounted in said vessel and adapted to be surrounded by said product, said support having an axial bore, said first cover having an opening coaxial with said support bore, a downwardly depending, non-self heating plunger affixed to said second cover, said plunger having a sliding fit through said first cover opening and within said support bore, said temperature responsive means comprising a fusible plug having a melting point closely approximating said preselected temperature, said fusible plug being located in said bore of said support, said plunger being supportable by said fusible plug to maintain said second cover in said first position, whereby when said product reaches said desired internal temperature causing said fusible plug to melt, said fusible plug will no longer support said plunger and said second cover will gravitate to said second position.

14. The structure claimed in claim 1, wherein said vessel has an open top, a first cover for said open top made of material reflective to said microwave energy and having at least one aperture premitting passage of said microwave energy to the interior of said vessel, a second cover reflective to said microwave energy and having at least one opening corresponding to said at least one opening of said first cover, said second cover being shiftable from a first position whereat its at least one aperture overlies said at least one aperture in said first cover and a second position whereat its at least one aperture does not overlie said at least one opening of said first cover substantially closing said at least one aperture of said first cover, said temperature responsive means being operatively connected to said second cover to maintain said second cover in said first position and to release said second cover to said second position upon attainment of said preselected temperature.

15. The structure claimed in claim 14 including a downwardly depending, non-self heating probe affixed to the underside of said first cover and of such length as to extend into and be surrounded by said product, said probe having an axial bore open at its upper end and closed at its lower end, a downwardly depending shaft affixed to the underside of said second cover, said shaft being receivable and rotatable within said probe bore, said temperature responsive means comprising a helical bimetallic actuator located within said probe bore and affixed at one end to said probe and at the other end to said shaft, said bimetallic actuator being configured to maintain said second cover in its first position via said shaft until heated to said preselected temperature by said surrounding product whereupon said bimetallic actuator will rotate said second cover via said shaft to said second position.

16. The structure claimed in claim 15 wherein said first and second covers are provided with the same number of microwave energy passing apertures in the form of elongated radially oriented slots.

17. The structure claimed in claim 14 including a downwardly depending, non-self heating probe affixed to the underside of said first cover and of such length as to extend into and be surrounded by said product, said probe having an axial bore open at its upper end and closed at its lower end, a downwardly depending, non-self heating shaft affixed to the underside of said second cover, said shaft being receivable and rotatable within said probe bore, said temperature responsive means comprising a body of fusible material within said probe and having a melting point approximating said preselected temperature, said shaft extending into said fusible material and being held thereby against rotation with said second cover in said first position, means to urge rotation of said shaft and said second cover to said second position of said second cover and stop means determining said first and second positions of said second cover, whereby when said surrounding product reaches said preselected internal temperature, said fusable body will melt releasing said shaft and permitting said shaft and second cover to rotate to said second position of said second cover under the influence of said urging means.

18. The structure claimed in claim 17 wherein said means to urge rotation of said shaft and said second cover comprises spring means, said stop means comprising a slot in said probe and a pin on said shaft extending laterally thereof and into said slot, and slot being so sized that when said pin is at one end thereof said second cover is in its first position and when said pin is at the other end of said slot said cover is in its second position.

19. The structure claimed in claim 14 wherein said second cover is rotatively mounted with respect to said first cover, latch means maintaining said second cover in said first position, means urging said second cover to rotate from said first position to said second position, said temperature responsive means being so located as to extend into and be surrounded by said product within said vessel, said temperature responsive means being operatively connected to said latch to release said second cover upon attainment of said preselected temperature.

20. The structure claimed in claim 19 wherein one of said first and second covers has an opening therein, the other of said first and second covers having a depression therein corresponding in position to said opening when said second cover is in its first position, said latch means comprising an elongated member one end of which is configured to extend through said opening and into said depression to maintain said second cover in its first position, said temperature responsive means comprising a probe-like device having a normally retracted plunger, said plunger being shiftable to an extended position upon attainment of said preselected temperature, said temperature responsive means being so positioned that said plunger contacts the other end of said latch means to shift said latch means out of said opening and depression to release said second cover to its second position upon attainment of said preselected temperature.

21. The structure claimed in claim 14 wherein said first and second covers are vertically oriented, said second cover being slidably mounted on said first cover and biased to said second position by gravity, latch means maintaining said second cover in said first position, said temperature responsive means being so located as to extend into and be surrounded by said product within said vessel, said temperature responsive means being operatively connected to said latch means to release said second cover upon attainment of said preselected temperature.

22. The structure claimed in claim 21 including a hollow non-self heating probe affixed to said first cover and so positioned as to extend into said vessel and be surrounded by said product, a non-self heating piston being located within said hollow probe, one end of said piston having a nose adapted to extend through coaxial holes in said first and second covers when said second cover is in its first position, said temperature responsive means comprising a fusible plug located within said probe near the free end thereof and having a melting point approximating said preselected temperature, the other end of said piston contacting said plug, means biasing said piston toward said plug, whereby when said surrounding product attains said preselected internal temperature said plug will melt and said biasing means will shift said piston removing said nose thereof from said opening in said second cover releasing said second cover to its second position.

23. The structure claimed in claim 1 wherein said microwave energy has a frequency of 2450 MHz.

24. The structure claimed in claim 1 wherein said means responsive to said preselected temperature of said product is non-self heating when subjected to said microwave energy.

25. The structure claimed in claim 1 wherein said vessel comprises an outer liner of microwave energy reflective material, an inner liner and a layer of heat insulative material therebetween.

* * * * *